United States Patent [19]

Schulz et al.

[11] 4,084,353

[45] Apr. 18, 1978

[54] SPADE DRILL SHARPENING FIXTURE

[75] Inventors: Reginald O. Schulz; Larry R. Rivett, both of Bridgeport, Mich.

[73] Assignee: Houdaille Industries, Inc., Buffalo, N.Y.

[21] Appl. No.: 683,668

[22] Filed: May 6, 1976

[51] Int. Cl.[2] ..... B24B 19/00

[52] U.S. Cl. ..... 51/220

[58] Field of Search ..... 51/218 R, 218 A, 217 R, 51/217 A, 220

[56] References Cited

U.S. PATENT DOCUMENTS

| | | | |
|---|---|---|---|
| 2,394,202 | 2/1946 | Pollard | 51/218 A |
| 2,521,230 | 9/1950 | Larson | 51/220 |
| 2,521,231 | 9/1950 | Larson | 51/220 |
| 3,065,580 | 11/1962 | Benjamin | 51/220 |
| 3,183,634 | 5/1965 | Sweeny | 51/220 |
| 3,395,496 | 8/1968 | Sweeny | 51/220 |

*Primary Examiner*—Harold D. Whitehead

*Attorney, Agent, or Firm*—Hill, Gross, Simpson, Van Santen, Steadman, Chiara & Simpson

[57] ABSTRACT

A fixture for holding a spade drill on a reciprocable grinder table during the sharpening thereof comprises a base for resting on the grinder table, a rocker supported on the base and pivotable to various fixed positions for providing a selected dip angle, and means for supporting the spade drill on the upper side of the rocker in a predetermined angular relation with respect to the horizontal table surface, such angular relation providing the rake angle for enabling grinding the top-rake flat of the drill. The base can be tilted to rest on a rear support surface which is disposed in a predetermined angular relation to enable grinding of the clearance portion of the spade drill at a proper angle. Selection of skew angle is also provided as a feature. The fixture can accommodate an entire series of spade drills to be ground to various dimensional specifications.

9 Claims, 11 Drawing Figures

SPADE DRILL SHARPENING FIXTURE

BACKGROUND OF THE INVENTION

1. Field of the Invention

This invention relates to a fixture for holding a number of spade drills of various size, one at a time, on a reciprocable grinding table to facilitate the sharpening of the spade drill.

2. Prior Art

Spade drilling is a relatively new art, but as the art has emerged from various commercial sources, various problems have already arisen in connection with the sharpening at original manufacture and the resharpening after use in the field. In some instances, there has been considerable overhang of the blade, necessitating a slower feed of the grinding wheel, and some sacrifice in accuracy. Further, as such spade drills or blades must be ground on two sides, the labor in fixing or locating the spade drill for work on one side has had to be repeated in order to sharpen the other side of the drill. Because of the complexity of the configuration of the cutting end of a spade drill, the various adjustments and settings have not been easy and often times have not been accurate. Repeatability has at times been difficult to achieve. Further, more sophistication can be expected at the factory than one might find in the facilities of the user, an example of which is the control of the skew angle, not always heretofore duplicated after use. Because of the complexity and sophistication involved, the use of skilled personnel has been necessary to operate the tool grinder.

SUMMARY OF THE INVENTION

According to the present invention, a fixture is provided for holding a spade drill on a reciprocable grinder table during the sharpening thereof, such fixture comprising a base normally resting on the grinder table, a rocker supported on the base and pivotable about a horizontal axis to a selected fixed position, and means for supporting the spade drill on the upper side of the rocker in a predetermined angular relation with respect to the horizontal axis. The fixture has an angularly oriented rear surface onto which the fixture can be tilted for grinding the clearance. Further, the base has a number of skew angle reference surfaces by which the fixture can be oriented with respect to the line of travel of the grinder table.

Accordingly, it is an object of the present invention to provide a fixture for holding spade drills on a reciprocable grinder table during the sharpening thereof.

Another object of the present invention is to provide a fixture for grinding the top-rake flat and the clearance of a spade drill.

A further object of the present invention is to provide a spade drill sharpening fixture which can be utilized with a wide variety of sizes of spade drill which have individual dimensional requirements to be met during grinding.

A further object is to provide a spade drill sharpening fixture which has a minimum overhang of the blade when the top-rake flat is being ground.

A still further object of the present invention is to provide a spade drill sharpening fixture having support means so constructed and arranged that individual spade drills can be mounted or remounted without need for redetermining the proper location thereof.

Yet another object of the present invention is to provide a fixture of the type described that has rugged stability coupled with easy and accurate setability.

A still further object of the present invention is to provide a fixture of the type described by which accurate repeatable grinding of the blade geometry can be readily carried out, both in the factory and in the field.

A still further object of the present invention is to provide a fixture of the type described that makes sharpening a spade drill so easy that grinding personnel having limited skills can be easily and quickly instructed to accurately duplicate the factory grind.

Many other advantageous, features and additional objects of the present invention will become manifest to those versed in the art upon making reference to the detailed description and the accompanying sheets of drawings in which a preferred structural embodiment incorporating the principles of the present invention is shown by way of illustrative example.

ON THE DRAWING

AS SHOWN ON THE DRAWING

Figure 1:
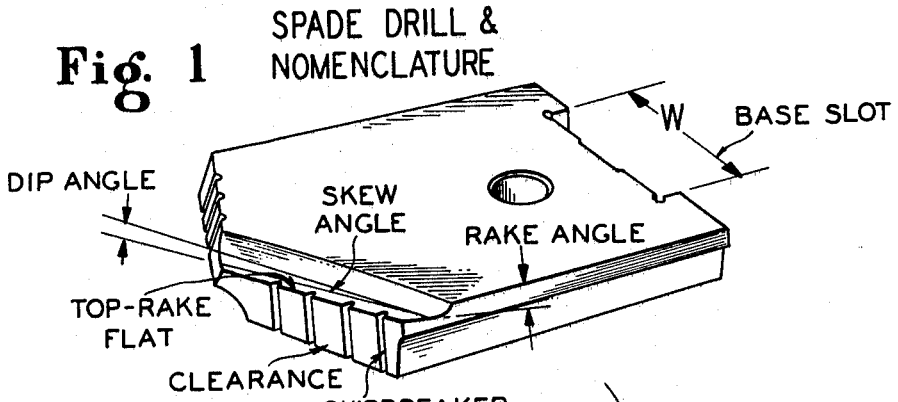
FIG. 1 is a perspective view of a spade drill.

The spade-drill industry does not uniformly use the same spade-drill or blade nomenclature. Since the industry and hence the art has no uniformity of a nomenclature, FIGS. 1 and 2 have been provided to show what a typical spade-drill looks like and also to provide definitions at the outset of terms that appear hereafter in the specification and in the claims. The terminology given does not go beyond that needed for a full understanding of the fixture of the present invention.

Figure 2:
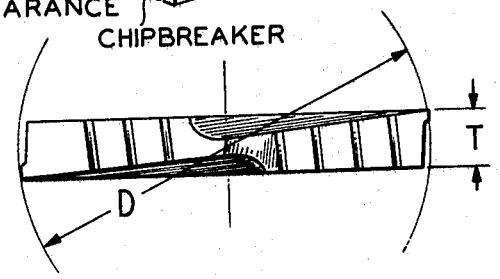
FIG. 2 is an end view thereof.

A spade drill has a diameter D shown in FIG. 2 and a thickness T. For accurate concentric location of the spade drill with respect to a tool holder, a spade drill has a base slot having a width W which lies between a pair of locating surfaces carried on rearwardly projecting ears. A spade drill has a cutting edge which is defined by the intersection of a top-rake flat and a surface referred to as clearance. The top-rake flat is the more difficult one to grind in that it must be ground with the proper dip angle and the proper skew angle and the proper rake angle each of which is diagrammed in FIG. 1. The clearance is ground to have a proper clearance angle with respect to one of the parallel sides or faces of the blade. The length of the spade drill is a perpendicular bisector of the base slot and the rotational axis of the spade drill is its length taken through the center of the blade between its flat major faces.

Using a representative series of sizes of spade drills, their diameters will range in size from 1.0 inch up to over 5 inches. Typical thicknesses will range from a little larger than one-eigth inch up to nearly three-fourths inch. Typical base slot widths will range from three-fourths inch up to 3½ inches. For convenience of discussion and for ease of use of the fixture, a typical set of specifications for spade drills has been broken down into eight groups, referred to herein as series A to H, respectively, each defined more accurately in a table set forth below. Thus thickness, base slot width, and skew angle are identified on the basis of the series referred to herein. However, the dip angle will vary according to manufacturing specifications in increments of 10 minutes for a range of between 1° and 2° for the range of diameters in a given series. Thus the proper dip angle constitues information furnished by the manufacture of the spade drill. If the operator lacks this information, the fixture as disclosed may give the grinding personnel a reasonably good approximation of the size of the dip angle at which grinding is to take place.

GRINDING FIXTURE CONSTRUCTION

The principles of the present invention are particularly useful when embodied in a fixture for holding spade drills on a reciprocable grinder table during the sharpening thereof, such as shown in side, front, and top views in FIGS. 3–6, generally indicated by the reference numeral 12. The fixture 12 includes a base 13 on which there is carried a rocker 14, the upper side 15 of which is provided with support means 16 shown in FIGS. 7 and 8 for holding a spade drill 17 thereon.

Figure 3:
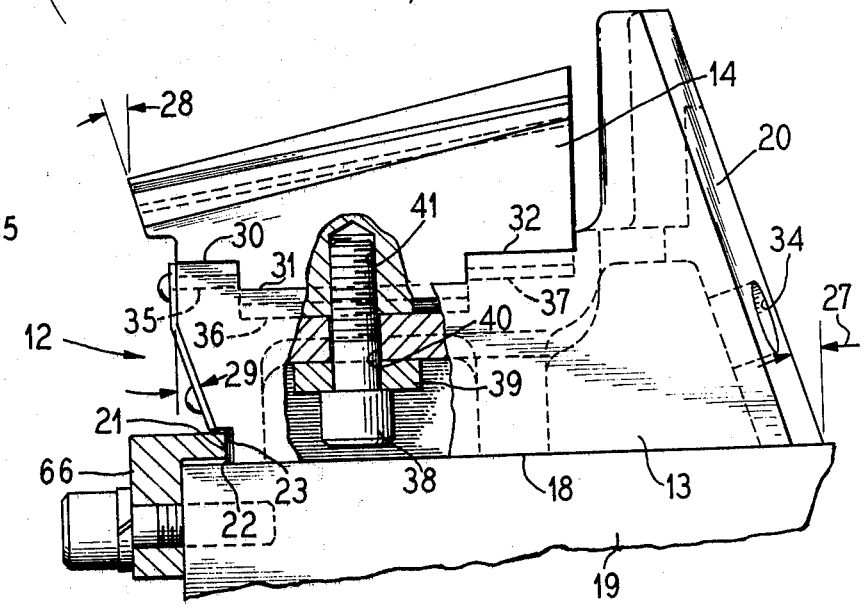
FIG. 3 is a side elevational view of a spade drill sharpening fixture provided in accordance with the principles of the present invention.
Figure 4:
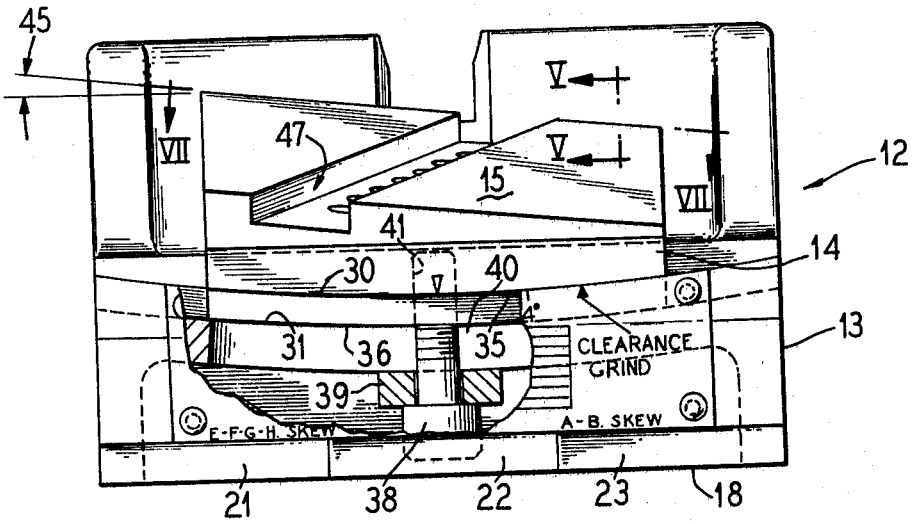
FIG. 4 is a front elevational view thereof.

As shown in FIGS. 3 and 4, the base 13 has a lower flat support surface 18 on which the fixture 12 is normally supported, such as on a magnetic chuck 19 carried by the reciprocable table of the grinder (not shown). The base 13 has a rear support surface 20 shown in FIGS. 3 and 6 onto which the fixture 12 can be tilted for grinding the clearance on the spade drill.

Figure 6:
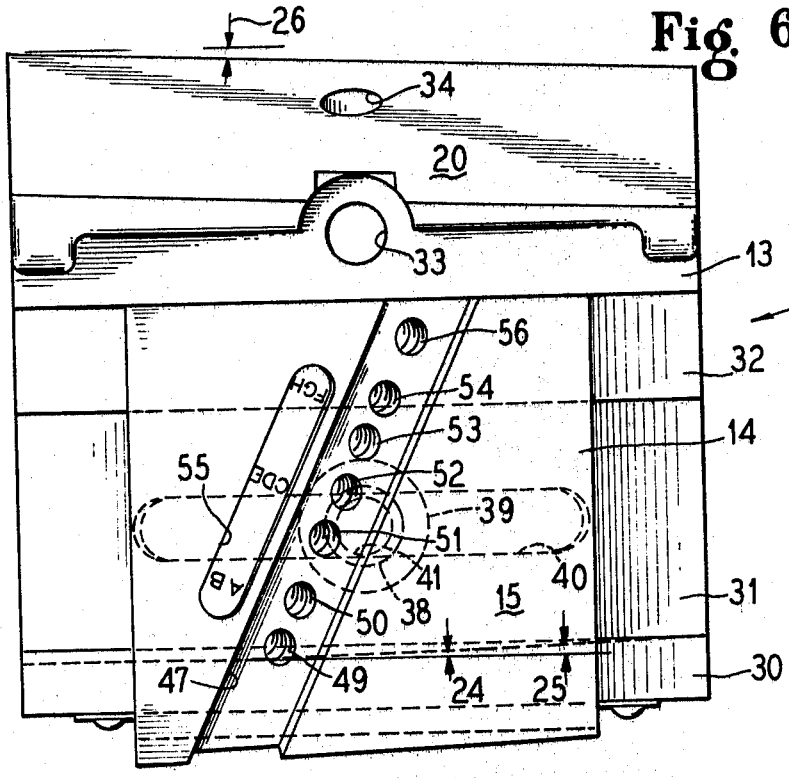
FIG. 6 is a top plan view of the fixture shown in FIGS. 3 and 4.

As shown in FIGS. 4 and 6, the base 13 has three skew angle reference surfaces 21, 22 and 23, all of which are perpendicular to the lower support surface 18. The skew angle reference surface 21 is parallel to the plane of the drawing. There is an angle of 179° 30′ between the reference surfaces 21 and 22, and a like angle between the surfaces 22, 23. Thus as shown in FIG. 6, an angle 24 comprises one-half degree while an angle 25 comprises one degree. Because of other parameters described below, the reference surface 21 inherently provides a skew angle of 2°, the reference surface 22 provides a skew angle of 2½° , while the reference surface 23 provides a skew angle of 3° when used as described below.

As shown in FIG. 6, the rear support surface 20 is inclined by an angle 26 of 1°, and as shown in FIG. 3 by an angle 27 of 18° whereby the rear support surface 20 has the proper predetermined angular relation with respect to the lower support surface. As also shown in FIG. 3, the forward edge of the rocker 14 is inclined by an angle 28 and the forward edge of the base 13 is inclined by an angle 29, both of which are 18°.

The base 13 has an upwardly directed concave surface which is divided into three segments, the edges of adjacent segments being parallel to each other, the segments being shown in FIG. 3 at 30, 31 and 32. The concave surfaces 30–32 have a common center of curvature greater than 21 inches. Thus they jointly provide relatively large support surface for the rocker 14, and it is easy to obtain increments of adjustment of dip angle as small as 10′ of angle.

The base 13 preferably comprises cast iron or other magnetic material so that it can be held on the magnetic chuck 19. If it is desired to bolt the fixture directly to a grinder table, such fastening can be accomplished by a conventional bolt passing through an aperture 33 shown in FIG. 6 which extends through the lower support surface 18 and an aperture 34 which extends through the rear support surface 20.

The rocker 14 has a set of convex surfaces 35, 36, 37 which are complemental to and which are engaged by the corresponding concave surfaces 30–32 respectively, the surfaces 31, 36 having a greater radius so as to provide a key-like structure that prevents any relative movement about a vertical axis between the rocker 14 and the base 13. To maintain the rocker 14 in a preselected position, a locking clamp is provided in the form of a headed screw 38 shown in FIGS. 3 and 4 passing through a washer or spacer 29 and an elongated slot 40 in the base 13 into a threaded aperture 41 in the rocker 14. The lower surface of the washer or spacer 39 is flat for engaging the head of the screw 38 while the upper surface thereof may be curved as shown to conform to the lower side of the base 13. The center of curvature of the concave and convex surfaces 30–32, 35–37 comprises a horizontal axis parallel to the lower support surface 18 about which the rocker 14 can be pivoted.

Figure 11:
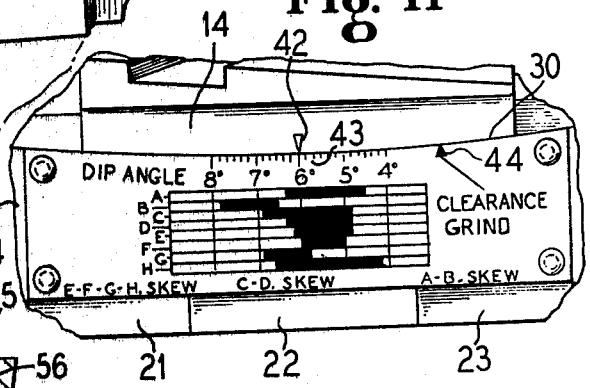
FIG. 11 is a front elevational view of a portion of FIG. 4 which has been broken away in FIG. 4.

The purpose of pivoting the rocker to a selected position is to select the dip angle to which the spade drill is to be ground. To that end, as best shown in FIG. 11, the rocker 14 is provided with an index mark 42 and a dip angle scale 43 is provided on a nameplate carried by the base 13. A special index is provided at 44 to which the rocker 14 is set when the clearance grind is to be made for any of the spade drills. The selected dip angle is provided for each spade drill by the manufacturer. Alternatively, the operator may refer to a scale having shaded portions that indicate the range of dip angles used for each one of the series of spade drills as defined in the table below. In order to set the dip angle, the locking clamp screw 38 is loosened, the rocker is moved to the desired position, and the locking clamp screw 28 is retightened. No further adjustment of dip angle is needed so long as spade drills of the same size are being ground. The shaded portions on the nameplate in FIG. 11 also alert the operator to an error in setting or to an error in his information if the index 42 is beyond the shaded range for a given series of tools. For convenience, the nameplate also contains identification as to which of the three skew angle reference surfaces 21–23 is to be used for the various series of tools.

In order to accommodate the support means 16, the upper side 15 of the rocker 14 has a predetermined angular relationship to the horizontal axis and with respect to the index mark 42.

Figure 5:
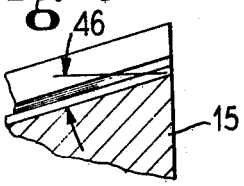
FIG. 5 is a fragmentary cross-sectional view taken along line V—V of FIG. 4.

With the rocker 14 centered as shown at the 6° dip angle, as shown in FIG. 4, the upper surface of the rocker is inclined by an angle 45 of 6° in one direction and as shown in FIG. 5 by an angle 46 of 12° in a front to rear direction. Into the thus angularly oriented upper surface 15, there is provided a slot 47 which extends at an angle 48 shown in FIG. 7 which is 24° 30′. The slot 47 is provided with a series of seven screwholes extending perpendicularly to the upper side 15, a pair of such holes 49, 50 being used as the primary locating means for series A and series B drills, a pair of holes 51, 52 being the primary locating means for tools in series C, D and E, and a pair of holes 53, 54 being utilized to accommodate tools in the F, G, and H series. If desired, for convenience of the user, as shown in FIG. 6, such series designations may be carried by indicia alongside the slot 47 in a further shallow slot 55. A further threaded aperture 56 is provided for use as described below in connection with grinding tools of the F, G, and H series.

Figure 9:
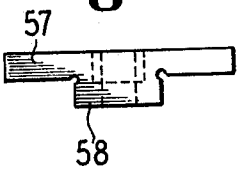
FIG. 9 is an end elevational view of one of a number of components of corresponding configuration used as shown in FIGS. 7 and 8.
Figure 10:
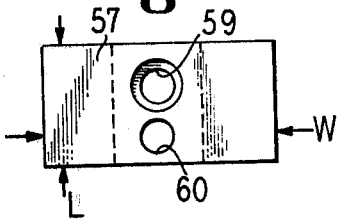
FIG. 10 is a top view of the component shown in FIG. 9.

In order to mount the spade drill on the upper surface 15, it is first necessary to select one of a series of locating blocks, a representative one of which is shown in FIGS. 9 and 10 and designated 57. Each locating block 57 has a downwardly projecting lug 58 which fits snugly and slidably in the slot 47. Each locating block 57 has a recessed aperture 59 and a further aperture 60. Each locating block 57 has a length W which corresponds to the base slot width W, the locating block being toleranced on the nagative side and the base slot width being toleranced on the positive side. Each of the locating blocks 57 has a front-to-rear length L which varies in accordance with the series of spade drill as shown in the table below, which compensates for use of one pair of holes 49–54 for different lengths of drill.

Figure 7:
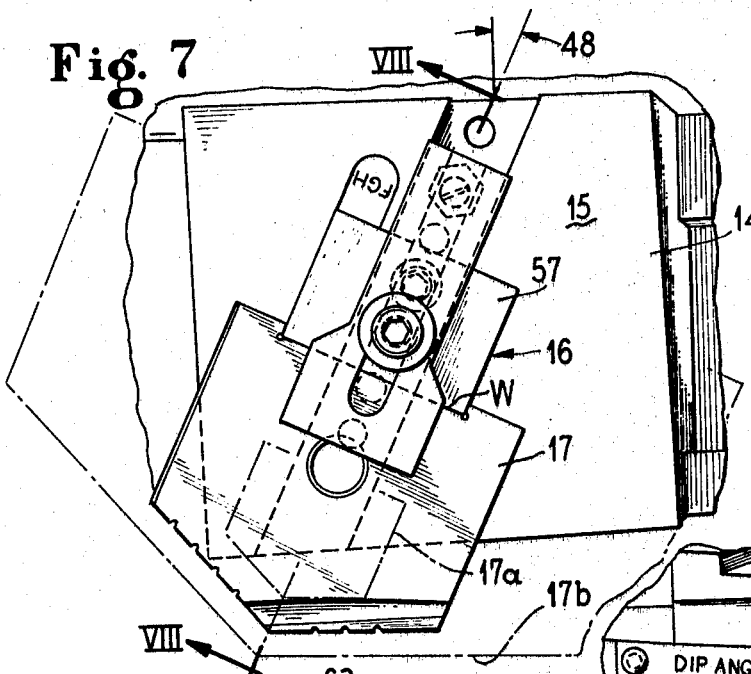
FIG. 7 is a projection taken in the direction indicated by line VII—VII of FIG. 4, perpendicularly to the portion embraced by such line.
Figure 8:
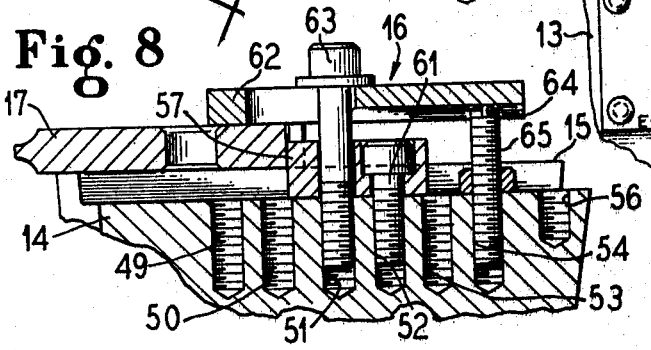
FIG. 8 is a fragmentary cross-sectional view taken along line VIII—VIII of FIG. 7.

The appropriate locating block 57 is lined up with an appropriate pair of holes illustrated in FIGS. 7 and 8 to be 51, 52, and by means of a headed screw 61, the locating block 57 is locked firmly in the slot 47. The spade drill 17 is then placed on the upper surface 15 and moved so that the base slot W thereof receives the locating block 17 endwise as best shown in FIG. 7. An elongaged clamp 62 is then superimposed above the tool 17 and is locked into place by means of a clamping screw 63. The clamping screw 63 passes through an elongated slot in the clamp 62, through the aperture 60 in the locating block 57, and with the present arrangement that is illustrated, into the aperture 51 in the rocker 14. Further, the clamp 62 is provided with a downwardly facing groove 64 which receives the upper end of a pivot screw 65 received and locked into the aperture 54. The pivot screw 65 thus also is positionable in the threaded aperture 52 and the threaded aperture 56 when smaller or larger tools are to be sharpened, respectively. The elongated slot and the elongated groove 64 facilitate proper registration for clamping.

OPERATION

To use the grinding fixture, the operator first ascertains which spade drill is to be ground, and from that information determines the series into which such drill falls. From this information, the proper locating block 57 can be selected and fastened in the slot 47 at the proper place. The tool 17 may then be secured and clamped to the upper side as shown in FIGS. 7 and 8.

The operator then determines the proper dip angle from information furnished by the manufacturer, and if this is unavailable, his knowledge of which series is involved and the range of diameters falling within a series enables him to come up with a satisfactory approximation of the proper dip angle, to which the rocker 14 is then set and locked.

From the operator's knowledge of which series is involved, he can then select the appropriate skew angle reference surface 21, 22 or 23.

As shown in FIG. 3, the magnetic chuck is provided with a locating rail 66. The edge of the locating rail 66 is placed parallel to the direction of travel of the grinder table. For absolutely true parallelism, the operator after securing the chuck 19 to the grinder table, will grind the locating surface on the locating rail, thus building absolute parallelism.

With the locating rail 66 so disposed, arranged and prepared, the fixture 12 is placed on the top of the magnetic chuck as shown in FIG. 3 with the appropriate one of the skew angle reference surfaces 21, 22 or 23 engaging the locating rail flatwise. The top-rake flat of one side of the spade drill is then ground. Then the clamp 62 is loosened, and the spade drill is turned over to the opposite side and again located against the location block 57 and clamped. The top-rake flat for that side is then ground.

In order to grind the clearance on the spade drill, the rocker 14 is locked with its index 42 in registration with the index 44, and the fixture 12 is tilted so as to rest on the rear support surface 20. Once so tilted, it can be locked in any position on the table of the grinder without any further orientation about a vertical axis or with respect to the direction of table movement. After the clearance has been ground on one side of the spade drill 17, the clamp screw 63 is loosened to enable the spade drill 17 to be turned over and supported with its other side against the side 15 of the rocker, as previously described.

FIG. 7 further shows in dot-dashed lines one of the smallest spade drills **17*a* in position to be ground and one of the largest spade drills 17*b* in position to be ground. This illustration shows that there is a minimum overhang of the blade for grinding the top rake, irrespective of the blade or spade drill size. Thus a relatively heavy feed of the grinding wheel is enabled without loss in grinding accuracy. Further, as explained, the opposite sides of the spade drill can be ground merely by release and reclamping of the spade drill without any special relocation activity. The large-radius concave and convex surfaces provide easy and accurate setting of the dip angle for grinding the top-rake flat, and those same surfaces are relatively large so as to provide substantial stability. The lower support surface 18 and the rear support surface 20 on the base 13 are relatively large for positive magnetic chucking and also contribute to the accurate repeatable grinding of the blade geometry. The ability to utilize the reference surfaces 21, 22, 23 to select skew angle insures duplication of the grind that is provided at the factory where the drill is made, and this fixture is sufficiently versatile so that it can be used not only for regrinding but for final factory grinding of the top-rake flat and clearance. The fixture 12** can be used interchangeably on magnetic chucks or on other support surfaces where the same is bolted thereto. To the user that is provided this fixture, it is relatively uncomplicated because of the built-in grinding aids, so that grinding personnel with limited skills can be easily and quickly instructed as to its use, and these personnel can then accurately duplicate the factory grind.

The following table sets forth the dimensions that define the various series of spade drills and the locating blocks 57 to be used therewith.

| SERIES | D DIAMETER RANGE | T THICKNESS | W BASE SLOT WIDTH | L |
|---|---|---|---|---|
| A | 1.0–1.250 | .187 | .7500 | 1.156 |
| B | 1.312–1.500 | .280 | 1.0625 | 1.031 |
| C | 1.562–2.000 | .312 | 1.2500 | 1.500 |

-continued

| SERIES | D DIAMETER RANGE | T THICKNESS | W BASE SLOT WIDTH | L |
|---|---|---|---|---|
| D | 2.062–2.500 | .374 | 1.7500 | 1.188 |
| E | 2.562–3.000 | .437 | 2.0625 | .969 |
| F | 3.062–3.500 | .499 | 2.6268 | 1.313 |
| G | 3.562–4.000 | .624 | 3.0625 | 1.094 |
| H | 4.125– | .687 | 3.5000 | .969 |

The chipbreakers of the spade drill are a number of grooves in the clearance, the bottom of which is parallel to the clearance. After the clearance has been ground, the fixture 12, still resting on the rear support surface 20, is oriented on the grinder table so as to place the length of the chipbreakers parallel to the direction of table travel. Using a grinding wheel having a profile corresponding to that of the chipbreaker, the grooves are then reground to a desired depth, the spade drill being flipped over for enabling grinding of the second set.

Although various minor modifications may be suggested by those versed in the art, it should be understood that we wish to embody within the scope of the patent warranted hereon, all such embodiments are reasonably and properly come within the scope of our contribution to the art.

We claim as our invention:

1. A fixture for holding spade drills on a reciprocable grinder table during grinding of the dip angle thereof, comprising:

(a) a base having a lower support surface for resting directly on the grinder table;

(b) means for adjusting the dip angle to be ground comprising a rocker directly supported on said base and pivotable about a horizontal axis disposed well above the fixture to a selected fixed position for setting at a selected dip angle;

(c) means for supporting the spade drill on the upper side of said rocker comprising a surface for directly supporting the spade drill in a predetermined angular relation with respect to said horizontal axis, and said angular relation providing the rake angle for enabling grinding the top-rake flat of the drill at the selected adjustable dip angle, whereby said upper side is disposed well below said horizontal axis; and (d) indicia on said base and on said rocker for indicating the actual dip angle in fractional increments less than one degree for any setting of said rocker.

2. A fixture according to claim 1, said rocker being pivotable to a different selected fixed position beyond the range of said dip angle indicia for grinding the clearance on the drill, said base having a rear support surface disposed in a predetermined angular relation with respect to said lower support surface, and on which rear support surface the fixture is to rest on the grinder table during grinding of the clearance, said angular relation of said rear support surface and the adjusted position of said rocker in said different position jointly providing the angle of the clearance.

3. A fixture according to claim 1 in which said base has three different skew angle reference surfaces perpendicular to said lower support surface for engaging a reference surface on the table which is parallel to the direction of table movement.

4. A fixture according to claim 3 in which said skew angle reference surfaces are angularly set off from each other in increments of one-half degree.

5. A fixture according to claim 1, said rocker having a plurality of normally downwardly directed convex surfaces, and said base having a corresponding plurality of normally upwardly directed concave surfaces of greater arcuate extent always fully underlying said rocker, said concave and convex surfaces each having a center of curvature lying in said horizontal axis, and said concave and convex surfaces slidably engaging one another.

6. A fixture according to claim 1 including a single headed-screw projecting upwardly through an elongated slot in said base into a threaded opening in a central tongue in said rocker for locking said predetermined angular relation.

7. A fixture according to claim 1 including a unitary locating block secured to the upper side of said rocker for being snugly received into the base slot of the spade drill, a slotted clamp overlying said locating block for acting on one face of the spade drill, a clamping screw passing therethrough into said rocker, said clamp having a downwardly facing groove, and a pivot screw secured in said rocker and having an upper end engaging said clamp in said groove, whereby rotation of said clamp is restricted.

8. A fixture according to claim 1 including a unitary locating block secured to the upper side of said rocker for being snugly received into the base slot of the spade drill, a slot in the upper side of said rocker extending along the rotational axis of the spade drill, said locating block having a lug projecting into said slot to prevent any rotation thereof with respect to said rocker, said slot being receptive of other unitary locating blocks sized to coact with spade drills having base slots of differing sizes.

9. A fixture according to claim 1 including a unitary locating block secured to the upper side of said rocker for being snugly received into the base slot of the spade drill, a slot in the upper side of said rocker extending along the rotational axis of the spade drill and receptive of a lug projecting from one of a number of said locating blocks, said rocker being adapted to have said locating block secured thereto while disposed at various points along the length of said slot to accommodate spade drills of differing lengths and constant base slot size.

* * * * *